United States Patent [19]

Torigoe et al.

[11] 4,065,233

[45] Dec. 27, 1977

[54] ELECTRIC BLOWER ASSEMBLY HAVING VOLUTE PASSAGES TO DIRECT AIR INTO MOTOR HOUSING

[75] Inventors: Masao Torigoe, Amagasaki; Kunihito Mori, Toyonaka; Mitsuru Tsuchiya, Suita; Seiji Takemura, Osaka, all of Japan

[73] Assignee: Matsushita Electric Industrial Co., Ltd., Kadoma, Japan

[21] Appl. No.: 595,421

[22] Filed: July 14, 1975

[30] Foreign Application Priority Data

| | | |
|---|---|---|
| July 16, 1974 | Japan | 49-81835 |
| July 16, 1974 | Japan | 49-82834 |
| Dec. 18, 1974 | Japan | 49-145942 |
| Dec. 18, 1974 | Japan | 49-145976 |
| Jan. 7, 1975 | Japan | 50-4750 |
| Feb. 26, 1975 | Japan | 50-24433 |
| Feb. 26, 1975 | Japan | 50-145941 |

[51] Int. Cl.[2] ..... F04B 35/04; F04B 39/06

[52] U.S. Cl. ..... 417/368; 417/369; 417/423 A; 415/211

[58] Field of Search ..... 417/423 A, 368, 369, 417/372, 423 R; 415/211, 501

[56] References Cited

U.S. PATENT DOCUMENTS

| | | | |
|---|---|---|---|
| 993,985 | 5/1911 | Harker | 417/369 |
| 1,034,894 | 8/1912 | Fisker | 417/423 A |
| 2,201,867 | 5/1940 | McMahan | 415/211 |
| 2,289,231 | 7/1942 | Auger et al. | 415/211 |
| 2,612,843 | 10/1952 | Gruetjen | 417/423 R |
| 2,658,665 | 11/1953 | Tschudy | 417/423 A |
| 3,341,113 | 9/1967 | Sebok et al. | 417/369 |
| 3,791,772 | 2/1974 | Keimpema et al. | 415/211 |

*Primary Examiner*—Carlton R. Croyle
*Assistant Examiner*—Thomas I. Ross
*Attorney, Agent, or Firm*—Wenderoth, Lind & Ponack

[57] ABSTRACT

There is disclosed an electric blower assembly provided with an air guide structure designed such that the current of air expelled from a rotating impeller under the influence of centrifugal force is guided to the body of an electric motor while being accelerated. The air guide structure comprises an air guide block having front and rear compartments. The front compartment includes a plurality of volute chambers designed such that, during flow of air within the volute chambers, the dynamic pressure can be converted into static pressure. The flow of air under the static pressure is subsequently guided at a relatively low pneumatic velocity into the rear compartment and then into the body of the motor to cool the latter. The air used to cool the motor is thereafter exhausted to the outside of the motor.

5 Claims, 16 Drawing Figures

ELECTRIC BLOWER ASSEMBLY HAVING VOLUTE PASSAGES TO DIRECT AIR INTO MOTOR HOUSING

The present invention generally relates to an electric blower assembly and, more particularly, to an electric blower assembly of a type used in a vacuum cleaner for creating a substantial vacuum within a dust collecting chamber of the vacuum cleaner.

In this type of blower assembly used, or useable, in most vacuum cleaners, emphasis is generally placed on requirement of the flow rate of pneumatic medium blown, rather than the pressure of pneumatic medium blown, to obtain an optimum performance of a vacuum cleaner. In other words, the value of negative pressure which can be achieved by the blower assembly during operation thereof, is taken into consideration as one of the major factors dominating the performance of the vacuum cleaner.

On the other hand, where the blower assembly is to be installed in a vacuum cleaner for home use, a limitation is imposed on the size of the blower assembly so that the vacuum cleaner can be manufactured in a size as compact as possible.

In order for the vacuum cleaner to fulfill these requirements simultaneously, that is, to achieve a negative pressure as high as possible and a size as compact as possible, it is general practice to employ a centrifugal fan in combination with a high speed commutator motor capable of rotating at a speed of, for example, 15,000 to 25,000 rpm. The employment of the commutator motor in fact results in reduction of the size of the vacuum cleaner as compared with the result achieved by the use of an induction motor capable of giving the same output as that of the commutator motor. More specifically, in order to give the same output, the commutator motor can be smaller in size than the induction motor and uses a centrifugal fan of a smaller size than that required by the induction motor. Accordingly, the overall size of the commutator motor combined with the centrifugal fan is smaller than that of the induction motor combined with the centrifugal fan.

While the use of the commutator motor has these advantages, it has a disadvantage that the temperature of the commutator motor tends to be easily elevated during the operation thereof and, therefore, the employment of the commutator motor requires the commutator motor to be cooled during the operation thereof.

A conventionally practised method of cooling the commutator motor is to utilize the flow of air created by the centrifugal fan during the operation of the motor and, for this purpose, the blower assembly is designed so that the flow of air created by the centrifugal fan is guided into the body of the commutator motor. However, for a reason which will become clear from the subsequent description made with reference to FIG. 1, the flow of air created by the centrifugal fan and being guided towards the body of the commutator motor is, it has been found, subjected to a resistance to such an extent as to reduce the fan efficiency.

More particularly, with reference to FIG. 1 in which a conventionally used blower assembly is shown, the blower assembly is designed such that a stream of air, created by the rotation of an impeller 101 and radially outwardly flowing from said impeller 101 at a relatively high speed, is, after having impinged upon a cylindrical wall portion of a front cover 102, deflected substantially at right angles in a direction parallel to the axis of rotation of the impeller 101, the deflected stream of air being subsequently deflected at right angles in a direction parallel to the plane of rotation of the impeller 101 so as to flow into the body of the motor 104 through a diffuser 103 which is positioned rearwardly of the impeller 101 and between the impeller 101 and the motor 104. Thereafter the stream of air entering through the diffuser 103 after having been deflected twice as hereinbefore described, flows in a radially inward direction towards the motor axis and is further deflected substantially at right angles in a direction parallel to the motor axis prior to flowing into the body of the motor 104 to cool the latter.

In the conventional blower assembly referred to above, since turbulent flow occurs at each locality where the stream of air flowing at the high speed from the impeller 101 is acutely deflected, the fan efficiency is considerably lowered.

Accordingly, an essential object of the present invention is to provide an improved blower assembly capable of exhibiting a relatively high fan efficiency with substantial elimination of the disadvantages inherent in the conventional device of a similar kind.

Another important object of the present invention is to provide an improved blower assembly wherein the motor can, accordingly, be cooled effectively and efficiently without the fan efficiency being sacrificed.

A further object of the present invention is to provide an improved blower assembly which is compact in size and which can easily be manufactured.

In accomplishing these objects, according to the present invention, there is provided a blower assembly which comprises an electric motor having a drive shaft, an air guide structure rigidly mounted on said motor and at least one impeller rigidly mounted on said drive shaft and operatively accommodated within the air guide structure. The air guide structure comprises a front cover having a central suction opening and an air guide block having front and rear compartments formed therein. The front compartment is closed by the front cover having the central suction opening in communication with said front compartment while the rear compartment is in communication with the body of the motor.

The front compartment includes a circular chamber for accommodating therein the impeller and a plurality of volute chambers each spirally, radially outwardly extending from the periphery of said circular chamber in a direction substantially parallel to the direction of rotation of the impeller and terminating at a substantially inclined passage formed in said guide block adjacent the outer periphery thereof. On the other hand, the rear compartment includes exhaust chambers equal in number to the number of the inclined passages and, therefore, the number of the volute chambers in the front compartment, which exhaust chambers are in communication with the volute chambers through the respective inclined passages. The exhaust chambers in the rear compartment may be either isolated from each other or communicated with each other.

The present invention is featured by the employment of the air guide structure designed such that the current of air created by the rotation of the impeller and spirally outwardly expelled from the periphery of the impeller can be guided into the volute chambers and subsequently into the exhaust chambers through the inclined passages, without being substantially acutely deflected.

More specifically, each of the volute chambers is communicated to the associated exhaust chamber through the passage so inclined that the path of travel of the air current from the volute chamber towards the exhaust chamber is substantially straight while the volute and exhaust chambers are located on respective sides with respect to the associated inclined passage and in a substantially offset relation relative to the plane of rotation of the impeller.

These and other objects and features of the present invention will become apparent from the following description taken in conjunction with preferred embodiments thereof with reference to the accompanying drawings, in which.

Figure 1:
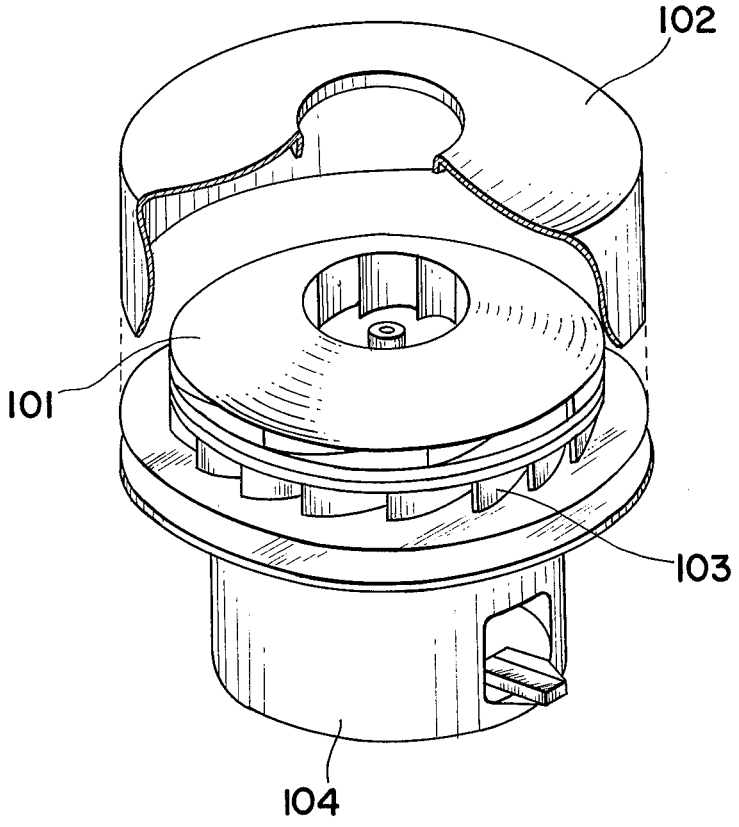
FIG. 1. Prior Art
FIG. 1 is a perspective view of the conventional blower assembly, with the front cover shown as separated from a motor to show an arrangement of the impeller and diffuser, which blower assembly has already been referred to in the foregoing description.

Before the description of the present invention proceeds, it should be noted that like parts are designated by like reference numerals throughout the accompanying drawings except for FIG. 1. It is also to be noted that the relative terms "front" and "rear" hereinbefore and hereinafter employed are to be construed as based on the direction of flow of air during operation of the blower assembly in relation to the axis of rotation of the impeller.

Figure 2:
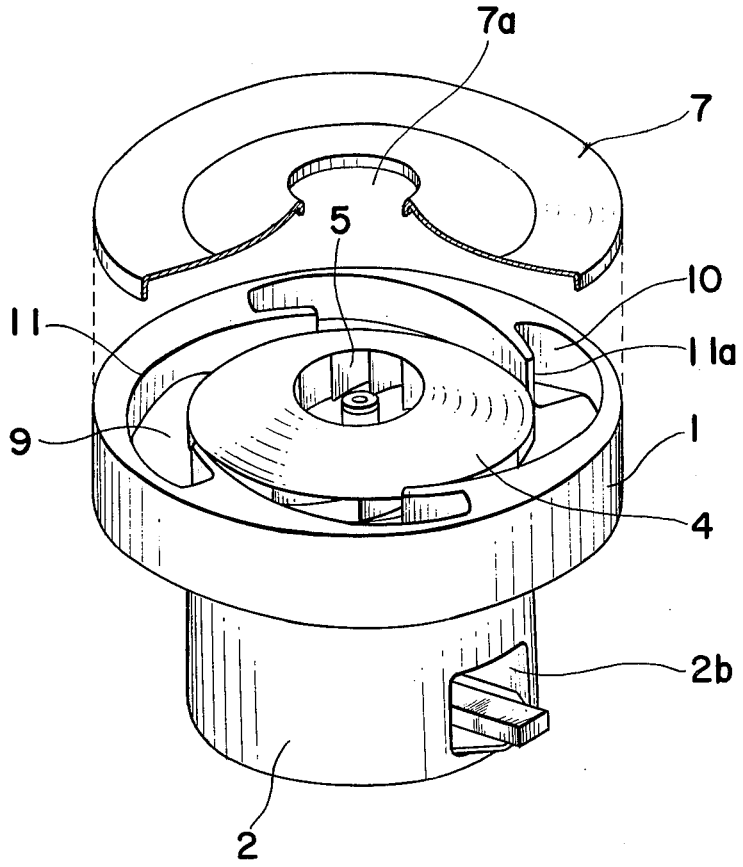
FIG. 2 is a view similar to FIG. 1, showing a blower assembly according to one embodiment of the present invention.
Figure 3:
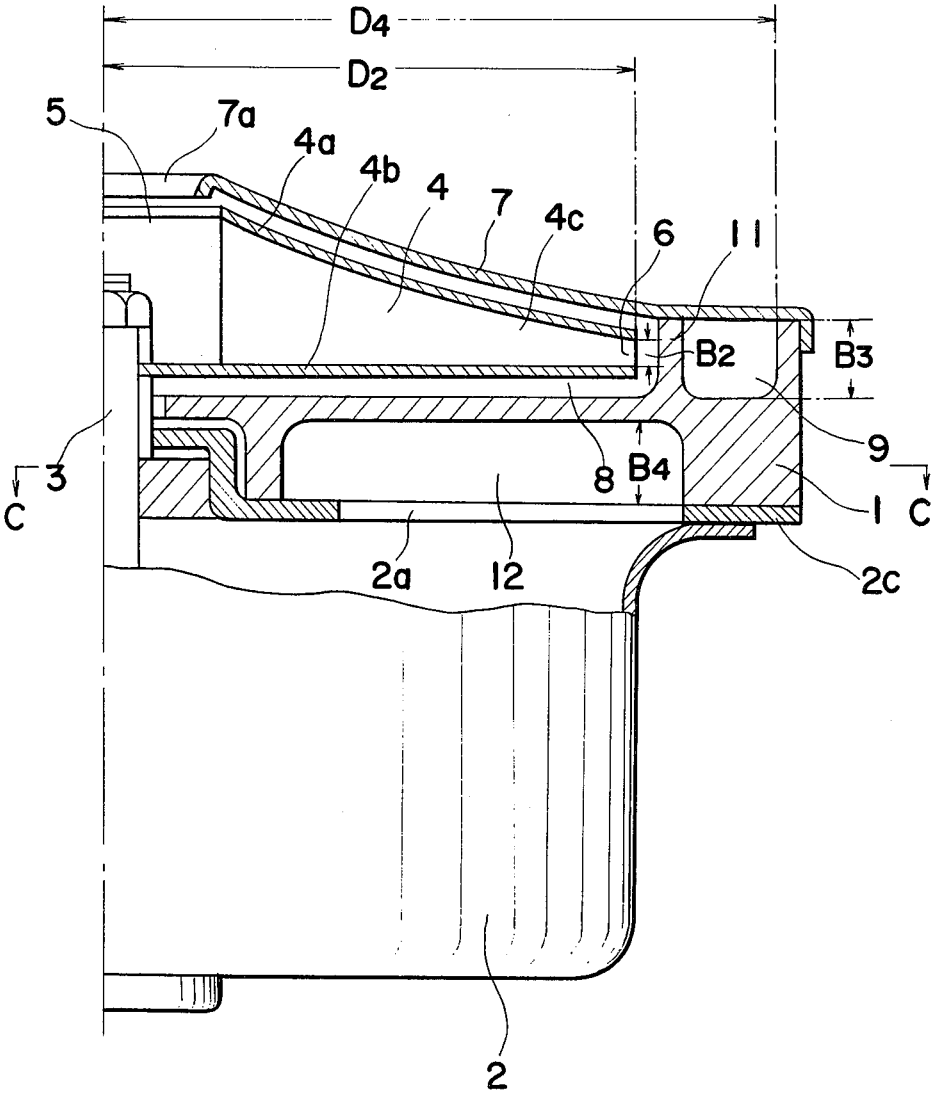
FIG. 3 is a longitudinal sectional view, on an enlarged scale, of one of the halves of the blower assembly of FIG. 2 divided along the axis of rotation of the motor.

Referring first to FIGS. 2 to 6, there is shown a substantially cylindrical motor casing 2 having one end closed and the other end radially outwardly flanged as best shown in FIG. 3. The motor casing 2 accommodates therein an electric motor (not shown) stationarily held therein and having a drive shaft 3, and has at a portion adjacent the closed end thereof an exhaust opening **2*b* through which air is, after having been used to cool the motor within the motor casing 2 in a manner as will be described later, exhausted to the outside of the blower assembly. As best shown in FIG. 3, the motor casing 2 includes a substantially disc-shaped bearing frame 2*c* having a central portion opened to provide a bearing bore, said bearing frame being rigidly secured to the flanged end of the motor casing 2 with said drive shaft 3** rotatably extending through said bearing bore.

As best shown by the chain line in FIG. 3, the bearing frame **2*c* had a plurality of, for example, four, opening 2*a* arranged around the drive shaft 3**.

Rigidly secured to the flanged end of the motor casing 2 through the bearing frame **2*c* is an air guide structure which comprises an air guide block 1 having front and rear compartments. The front compartment includes a circular chamber 8 in which an impeller 4, rigidly mounted on the drive shaft 3 for rotation together with said drive shaft 3, is operatively accommodated. The impeller 4 is, in the instance as shown, composed of outer and inner discs 4*a* and 4*b* and a plurality of spirally, radially outwardly extending blade members 4*c* secured in position between said outer and inner discs 4*a* and 4*b*, which blade members 4*c* are all substantially tapered in a direction away from the axis of rotation of said impeller 4 so that, while the inner disc 4*b* remains flat and is equally spaced from the bottom of the circular chamber 8, the assembled impeller 4 has a substantially bevel shape in cross-section as best shown in FIG. 3. The impeller 4 has a suction port 5 formed in the outer disc 4*a* in alignment with the axis of rotation of the impeller 4 and, hence, the drive shaft 3, and is designed such that, during rotation of said impeller 4 at a high speed, for example, 15,000 to 25,000 rpm. in a direction as indicated by the arrow in FIG. 4, air is first drawn into the suction port 5 under the influence of centrifugal force, exerted by the rotation of the impeller 4, subsequently moves centrifugally within substantially spirally curved passages, which are respectively defined by the outer and inner discs 4*a* and 4*b* and blade members 4*c*, and is finally expelled outwards from the impeller 4 into the circular chamber 8 through exits 6, each of which exits 6 is defined by one of the opposed ends of any of the spirally curved passages adjacent the outer periphery of the discs 4*a* and 4*b*. As is well known to those skilled in the art, this process of flow of air from the suction port 5 to the exits 6** relies on the centrifugal force being generated during the high speed rotation of the impeller 4.

The air guide structure further comprises a front cover 7 similar in sectional shape to the outer disc 4*a* of the impeller 4, which front cover 7 has an opening 7*a* and is mounted on the air guide block 1 so as to close the circular chamber 8, overhanging the impeller 4 with the opening 7*a* aligned with the suction port 5 in the outer disc 4*a*.

Referring still to FIGS. 2 to 6, the details of the air guide structure will now be described.

Figure 4:
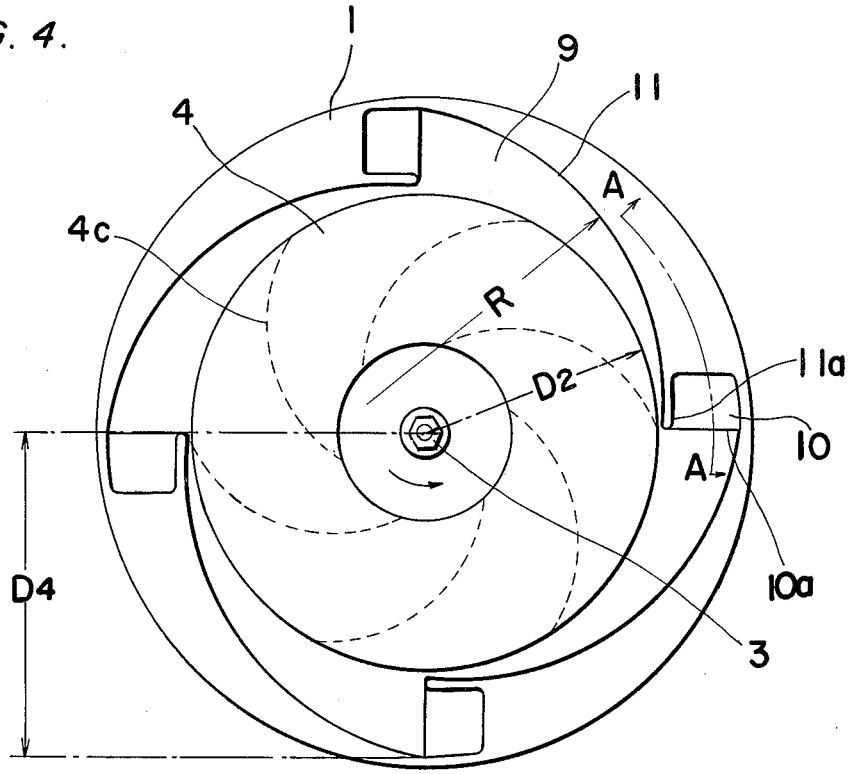
FIG. 4 is a top plan view of an air guide structure with the cover removed, which air guide structure is shown in FIG. 2.

As hereinbefore described, the air guide block 1 has front and rear compartments, said front compartment including the circular chamber 8 in which the impeller 4 is accommodated. The front compartment further includes a plurality of volute chambers 9, four of which are illustrated in FIGS. 2 and 4 for the purpose of the description of the present invention. While the details of each of the volute chambers 9 will subsequently be described, a portion of the air guide block 1 adjacent the outer periphery thereof has inclined passages 10 equal in number to the number of the volute chambers 9, which inclined passages 10 are substantially equally spaced from each other in the circumferential direction of the guide block 1 and also from the axis of the drive shaft 3. Each of these inclined passages 10 has an intake port 10*a* open at and flush with the bottom of the corresponding volute chamber 9 and an outlet port 10*b* open within the rear compartment in a substantially offset relation to the associated intake port 10*a* as will be described in more detail later.

In practice, each of the volute chambers 9 forms a substantial part of the circular chamber 8 and is defined by the bottom of the circular chamber 8 and a curved wall 11 which extends spirally radially outwardly from a volute tongue 11*a*, located adjacent the outer periphery of the impeller 4 and above the intake port 10*a* of one of the inclined passages 10, and terminates immediately above the radially outermost portion of the intake port 10*a* of the inclined passage 10 next adjacent to said one of said inclined passages with respect to the direction of rotation of the impeller 4, the distance between the axis of the drive shaft 3 and the spirally radially outwardly extending wall 11 gradually increasing from the tongue 11*a* to the terminating end of the wall 11. It is to be noted that each of the volute tongues 11*a* is defined by one end of the associated curved wall 11 which is opposed to the terminating end of said curved wall 11.

In the arrangement so far described, the front compartment in the air guide block 1 is designed such that a current of air expelled from the impeller 4 through the exits 6, which flows in a centrifugal direction with respect to the axis of rotation of the impeller 4 in substantially parallel relation to the curved walls 11, is guided into the volute chambers 9 and subsequently into the inclined passages 10 after having flowed along the curved walls 11. It is to be noted that at the time the current of air has entered the volute chambers 9, the flow of the air is accelerated and, as a result thereof, the dynamic pressure of the air is converted into a static pressure. Because of the configuration and orientation of each of the volute chambers 9, it is, therefore, clear that no air expelled from the impeller 4 substantially impinges upon the walls 11 to an extent that turbulent flow occurs, but is smoothly guided along the curved walls 11 into the inclined passages 10.

Figure 5:
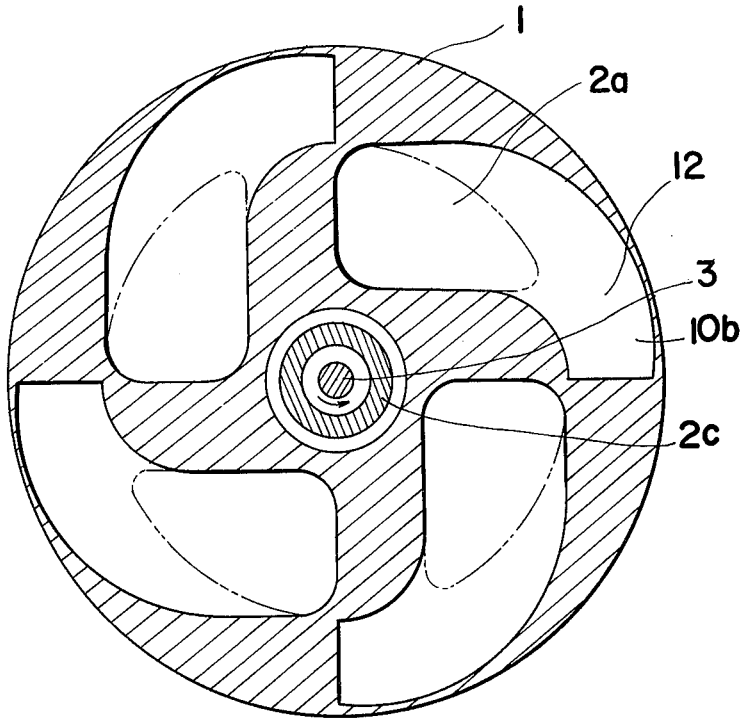
FIG. 5 is a cross sectional view of the air guide structure in a complete form taken substantially along the line C-C in FIG. 3.
Figure 6:
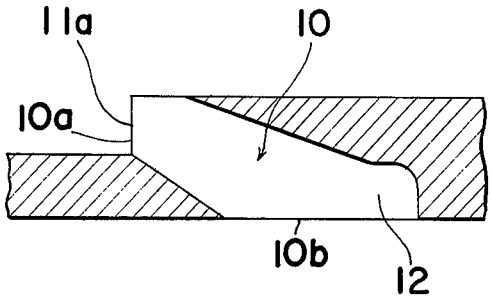
FIG. 6 is a side sectional view, on an enlarged scale, taken along the line A—A in FIG. 4, showing an arrangement of one of the inclined passages.

The rear compartment in the air guide block 1 includes, as best shown in FIGS. 3 and 5, exhaust chambers 12 equal in number to the number of the volute chambers 9, which exhaust chambers 12 are respectively communicated with the volute chambers 9 through the associated inclined passages 10. As can be understood from FIG. 5 in relation to FIG. 4, the inclined passages 10 are so inclined that the volute chambers 9 and the associated exhaust chambers 12 are in offset relation to each other. In other words, the exhaust chambers 12 are not located immediately below the volute chambers 9, but are displaced in the direction of rotation of the impeller 4 so that respective streams of air, which have entered the inclined passages in the manner as hereinbefore described, can be guided into the associated exhaust chambers 12 without being substantially sharply deflected. More specifically, each of the exhaust chambers 12 has one end immediately below the outlet port 10*b*, as best shown in FIGS. 5 and 6, and the other end in communication with the corresponding opening 2*a* in the bearing frame 2, a substantially intermediate portion of said exhaust chamber 12 substantially extending in a spirally centripetal direction with respect to the axis of rotation of the impeller 4.

The air entering the exhaust chambers 12 in the manner as hereinbefore described in turn flows into the motor casing through the openings 2*a* to cool the body of the motor within the motor casing 2 and is subsequently exhausted to the atmosphere through the exhaust port 2*b*.

With the above construction of the air guide structure according to the present invention, it is clear that the air expelled from the impeller 4 through the exits 6 into the circular chamber 8 is smoothly guided into the motor casing 2 through the volute chambers 9, then the inclined passages 10 and finally the exhaust chambers 12 by means of the openings 2*a* in the bearing frame 2*c* without the direction of flow of said air current being substantially sharply and acutely deflected and that the fan efficiency is, therefore, improved with no substantial loss of energy of the flow of the air current.

More specifically, since respective routes for the flow of air from the volute chambers 9 to the associated exhaust chambers 12 through the corresponding inclined passages 10 are independent from each other, the separate streams of air entering the respective volute chambers 9 and subsequently the exhaust chambers 12 through the inclined passage 10 no longer join together during the flow thereof from the volute chambers 9 to the exhaust chambers 12. This is particularly important in facilitating exhaust of the air to effectively cool the body of the motor within the motor casing 2. If the routes referred to above are otherwise joined together anywhere in the air guide structure, not only will turbulent flow occur at each locality where the routes are joined together, but also unnecessary revolving of air around the axis of rotation of the drive shaft 3, which will result in consumption of the exhaust energy, will occur.

The effective and efficient exhaust of air from the suction opening 7*a* to the atmosphere through the exhaust port 2*b* in the blower assembly according to the present invention contributes to improvement in the suction power of the blower assembly.

In addition, since each of the inclined passages 10 is so inclined as hereinbefore described, no substantial resistance is imparted to the flow of the stream of air from the associated volute chamber 9 towards the exhaust chamber 12 therethrough.

While the air guide structure is constructed as hereinbefore described, it is preferred that the distance between the axis of rotation of the impeller 4 and, therefore, the axis of the drive shaft 3, and the terminating end of each of the curved walls 11, as indicated by $D_4$ in FIGS. 3 and 4, have the following relation with the radius of circle of the impeller 4 as indicated by $D_2$ in FIGS. 3 and 4:

$$1.2 \cdot D_2 < D_4 < 1.4 \cdot D_2$$

This is because it has been found that the relationship between the distance $D_4$ and the radius $D_2$ more or less affects the fan efficiency as will now be described with particular reference to FIGS. 7 and 8.

Figure 7:
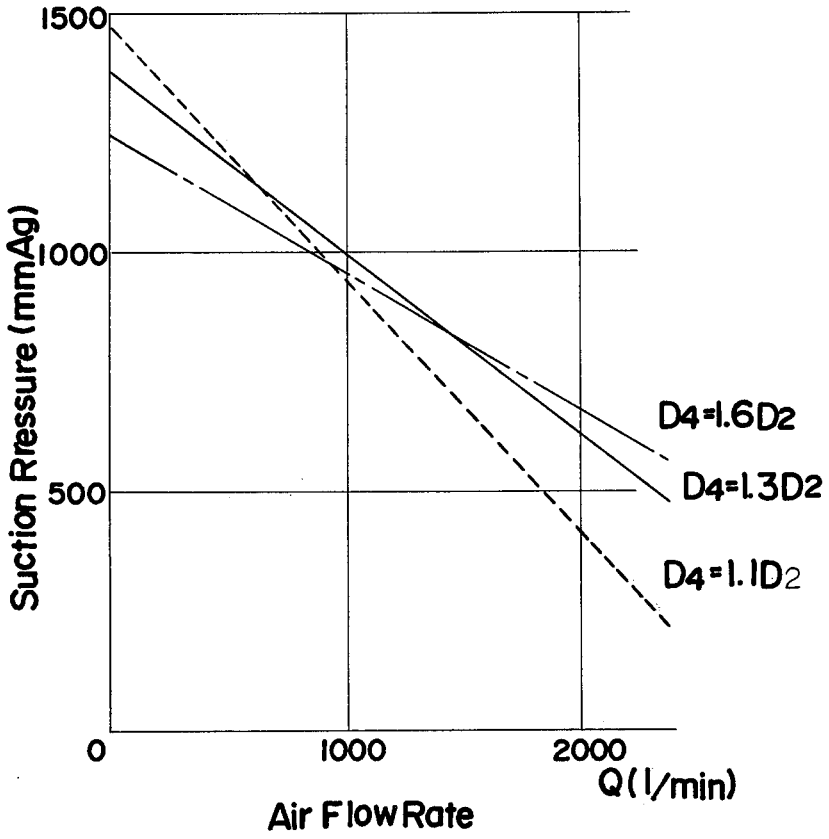
FIG. 7 is a graph showing the relationship between the suction pressure and the amount of air flow with respect to different values of the maximum distance between the axis of rotation of the impeller and a portion of the wall of each volute chamber adjacent the corresponding inclined passage.

FIG. 7 is a graph showing how the suction pressure varies with an increase of the flow rate of air Q, which graph was obtained during a series of experiments conducted by the inventors using the blower assembly of the construction of FIGS. 2 to 6 wherein the number of volute chambers 9 was four, the radius $D_2$ of the impeller 4 was 56 mm. and the radius of curvature R of each of the curved walls 11 was 80 mm. while the distance $D_4$ was varied within the range of 61.5 to 97.5 mm. In the graph of FIG. 7, the broken line represents the performance characteristic of the blower assembly wherein the distance $D_4$ was 1.1 times the radius $D_2$, the solid line represents a performance characteristic of the blower assembly wherein the distance $D_4$ was 1.3 times the radius $D_2$, and the chain line represents a performance characteristic of the blower assembly wherein the distance $D_4$ was 1.6 times the radius $D_2$.

From the graph of FIG. 7, it is clear that, in the case where the value of the distance $D_4$ is relatively great, for example, $D_4 = 1.6 \cdot D_2$, the shut-off pressure, which means the suction pressure at the time the flow rate Q is zero, is smaller than that achieved by any of the blower assemblies wherein $D_4$ is $1.3 \cdot D_2$ and $1.1 \cdot D_2$, respectively, while the blower assembly with $D_4 = 1.6 \cdot D_2$ exhibits a higher suction pressure than that exhibited by the other blower assemblies when the flow rate Q exceeds about 1,250 *l.* per minute. On the other hand, a relationship substantially opposite to the foregoing relation is clearly established where the value of the distance $D_4$ is relatively small. In other words, where the value of the distance $D_4$ is $1.1 \cdot D_2$, the shut-off pressure is greater than that achieved by any of the blower assemblies with $D_4 = 1.3 \cdot D_2$ and $D_4 = 1.6 \cdot D_2$, respectively, while the blower assembly with $D_4 = 1.1 \cdot D_2$ exhibits a lower suction pressure than that exhibited by the other blower assemblies when the flow rate Q exceeds 1,000 *l.* per minute.

Figure 8:
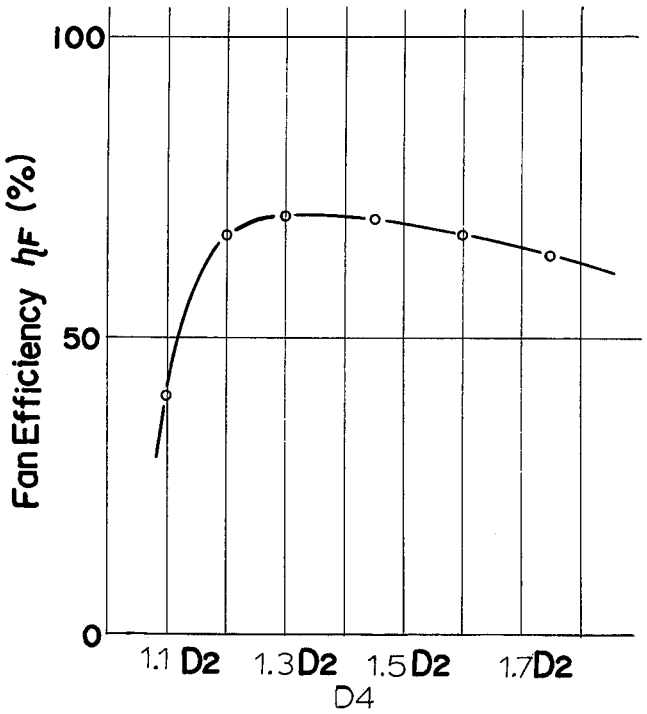
FIG. 8 is a graph showing the relation between the fan efficiency and the maximum distance between the axis of rotation of the impeller and a portion of the wall of each volute chamber adjacent the corresponding inclined passage.

FIG. 8 illustrates a graph showing how the fan efficiency $\eta_F$ varies with variation of the value of the distance $D_4$. From the graph of FIG. 8, it is clear that the fan efficiency $\eta_F$ becomes high when the value of the distance $D_4$ exceeds $1.2 \cdot D_2$.

However, for a fan used in a vacuum cleaner, the blower assembly of light-weight with a fan diameter as small as possible is preferred in terms of improvement of the position of the vacuum cleaner in the market. In addition, the vacuum cleaner is generally operated during actual cleaning at a flow rate Q of not more than 1,600 liters per minute. Therefore, the blower assembly, which has a relatively high suction pressure at a flow rate Q of not less than 1,600 liters per minute, is not necessary for practical use and a blower assembly wherein the distance $D_4$ is within the range of 1.2 times the radius $D_2$ to 1.4 times the radius $D_2$ suffices for use in a vacuum cleaner particularly for home use.

It is to be noted that the foregoing optimum condition concerning the distance $D_4$ is a mere example and may vary depending upon the depth of each of the volute chambers 9, as indicated by $B_3$ in FIG. 3, and/or the radius of curvature R of each of the curved walls 11.

As regards the radius of curvature R of each of the curved walls 11, it is preferred that the value of the radius of curvature R be within the range of a value equal to the radius $D_2$ to 1.3 times the radius $D_2$ and, therefore, the following relation can be established:

$$1.0 \cdot D_2 < R < 1.3 \cdot D_2$$

Figure 9:
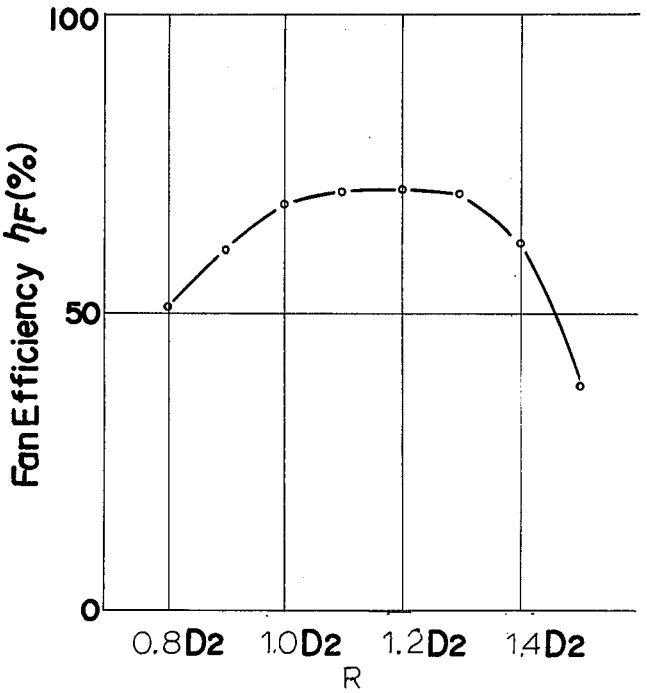
FIG. 9 is a graph showing the relation between the fan efficiency and the radius of curvature of the outer wall of each of the volute chambers.

The reason for this will be described with reference to FIG. 9 which illustrates how the fan efficiency $\eta_F$ varies with variation of the radius of curvature R. The graph of FIG. 9 was obtained during a series of experiments conducted by the inventors using the blower assembly of the construction of FIGS. 2 to 6 wherein the number of volute chambers 9 was four, the radius $D_2$ of the impeller 4 was 56 mm. and the distance $D_4$ was 72.25 mm. while the radius of curvature R of each of the curved walls 11 was varied within the range of 0.8 times the radius $D_2$ to 1.5 times the radius $D_2$.

As regards the relationship between the suction pressure and the flow rate Q, it was found that the blower assembly with $R = 1.2 \cdot D_2$ exhibited a performance characteristic similar to the solid line in the graph of FIG. 7, the blower assembly with $R = 1.5 \cdot D_2$ exhibited a performance characteristic similar to the broken line in the graph of FIG. 7, and the blower assembly with $R = 0.9 \cdot D_2$ exhibited a performance characteristic similar to the chain line in the graph of FIG. 7. Accordingly, it can be said that the blower assembly wherein the value of the radius of curvature R is relatively great gives a relatively high suction pressure while the blower assembly wherein the value of the radius of curvature R is relatively small gives a relatively high flow rate.

However, since a vacuum cleaner is generally operated during actual cleaning at a flow rate within the range of 1,000 to 1,600 liters per minute as hereinbefore described, a blower assembly capable of giving a maximum suction pressure when the flow rate is within the above range is desirable. Therefore, a blower assembly wherein the radius of curvature R is within the range of $1.0 \cdot D_2$ to $1.3 \cdot D_2$ is preferred for practical use.

In the embodiment shown in FIGS. 2 to 6, each of the curved walls 11 has been described as having a single radius of curvature as indicated by R in FIG. 4. However, the foregoing optimum condition concerning the radius of curvature R may be equally applicable even in the case where each of the curved walls 11 has different radii of curvature so that said curved wall has an irregularily curved surface, not such a regularly curved suface as shown.

As regards the depth $B_3$ of each of the volute chambers 9, it is preferred that the value of the depth $B_3$ be within the range of twice the height $B_2$ of each of the exits 6 of the impeller 4 to three times the height $B_2$ and, therefore, the following relation can be established:

$$2 \cdot B_2 < B_3 < 3 \cdot B_2$$

As a result of a series of experiments conducted by the inventors using the blower assembly of the construction of FIGS. 2 to 6 wherein the number of volute chambers 9 was four, the height $B_2$ of each of the exits 6 was 5 mm., the distance $D_4$ was 72.5 mm. and the radius $D_2$ of the impeller 4 was 56 mm. while the depth $B_3$ of each of the volute chambers 9 was varied within the range of 8 to 20 mm, it was found that that blower assembly with $B_3 = 2.5 \cdot B_2$ exhibited a performance characteristic similar to the solid line in the graph of FIG. 7, the blower assembly with $B_3 = 1.6 \cdot B_2$ exhibited a performance characteristic similar to the broken line in the graph of FIG. 7, and the blower assembly with $B_3 = 4 \cdot B_2$ exhibited a performance characteristic similar to the chain line in the graph of FIG. 7.

In other words, in the case of the blower assembly with the value of the height $B_3$ which is relatively small, the shut-off pressure is relatively high on one hand and the suction pressure is not so high with an increase of the flow rate. On the contrary, in the case of the blower assembly with the value of the height $B_3$ which is relatively great, a relatively high suction pressure can be obtained when the flow rate is relatively great, but the suction pressure is insufficiently low when the flow rate is relatively small. However, although the blower assembly with the height $B_3$ equal to $2.5 \cdot B_2$ has exhibited the best performance of all blower assemblies with the height $B_3$ greater and smaller than $2.5 \cdot B_2$, the blower assembly with the height $B_3$ within the aforesaid range is practically acceptable and, therefore, preferred in view of the fact that the vacuum cleaner is generally operated during the actual cleaning at a flow rate not more than 1,600 liters per minute.

Even the height $B_4$, as indicated in FIG. 3, of each of the exhaust chambers 12 in the air guide block 1 affects the performance of the resultant blower assembly. Accordingly, it is, for the reason as will be described with reference to FIG. 11, preferred that the height $B_4$ be within the range of $0.14 \cdot D_2$ to $0.28 \cdot D_2$ and, therefore, the following relation with respect to the radius $D_2$ of the impeller 4 can be established:

$$0.14 \cdot D_2 < B_4 < 0.28 \cdot D_2$$

In general, it is considered that, if the height $B_4$ is relatively great, the pneumatic velocity becomes low with consequent improvement in the performance of the blower assembly. However, increase of the height $B_4$ means an increase of the size of the blower assembly and a relatively bulky blower assembly cannot be recommended for use in a vacuum cleaner. In addition, the relatively bulky blower assembly does not always result in an improved performance of the vacuum cleaner. Accordingly, in pursuit of the optimum condition concerning the height $B_4$ of each of the exhaust chambers 12, a series of experiments have been conducted by the inventors using the blower assembly of the construction of FIGS. 2 to 6 wherein the radius $D_2$ of the impeller 4 was 5.6 mm. and the number of the volute chambers 9 was four while the height $B_4$ was varied within the range of 3 to 22 mm. The results of the experiments are plotted in the graph of FIG. 11, from which it is clear that, when the value of the height $B_4$ is within the range of about $0.14 \cdot D_2$ to about $0.4 \cdot D_2$, the fan efficiency $\eta_F$ is relatively high.

Figure 10:
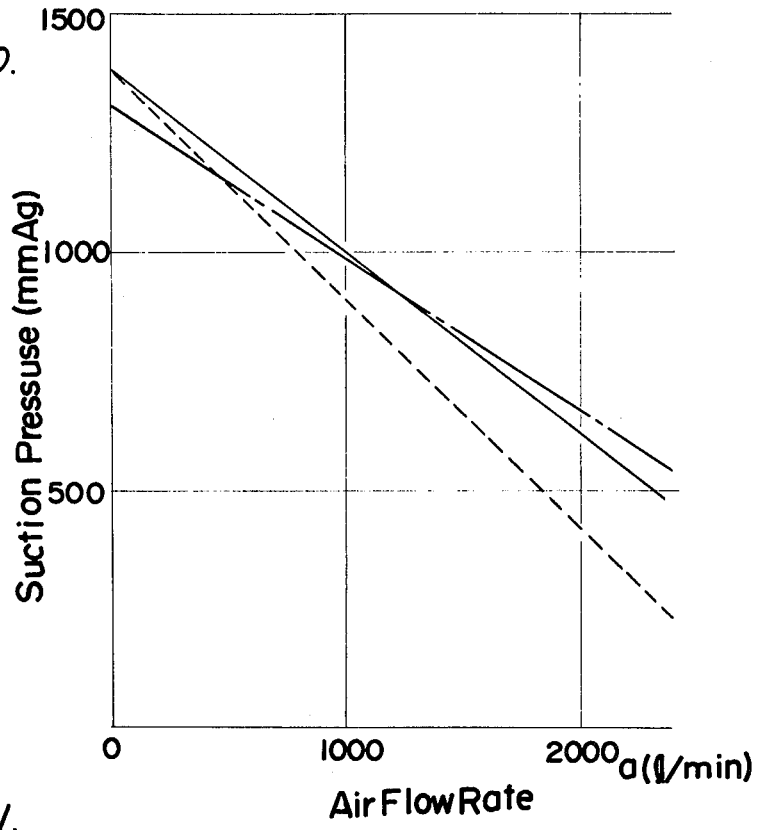
FIG. 10 is a graph showing the relationship between the suction pressure and the amount of air flow with respect to different values of the height of each of the exhaust chambers.

On the other hand, FIG. 10 illustrates a graph showing how the suction pressure varies with a variation in the flow rate Q, wherein the broken line represents a performance characteristic achieved by a blower assembly with height $B_4$ equal to $0.1 \cdot D_2$, the solid line represents a performance characteristic achieved by a blower assembly with a height $B_4$ equal to $0.2 \cdot D_2$ and the chain line represents a performance characteristic achieved by blower assembly with a height $B_4$ equal to $4 \cdot D_2$.

Figure 11:
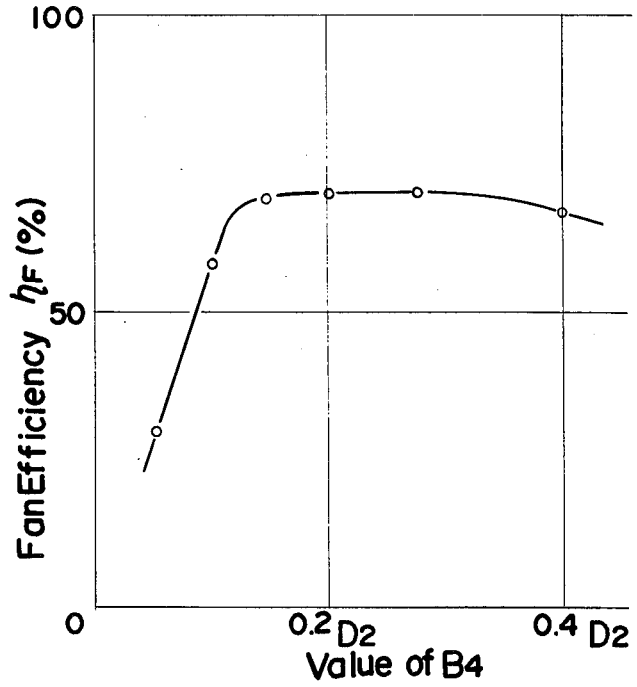
FIG. 11 is a graph showing the relation between the fan efficiency and the height of each of the exhaust chambers.

From the graphs of FIGS. 10 and 11, it will readily be seen that, when the height $B_4$ is relatively small, the fan efficiency $\eta_F$ is relatively low while, when the height $B_4$ is relatively great, the fan efficiency $\eta_F$ is relatively high. However, for the respective reasons that an increase of the height $B_4$ means an increase of the size of the blower assembly as hereinbefore described and that the vacuum cleaner is generally operated during actual use at a flow rate of not more than 1,600 liters per minute as hereinbefore described, such a performance characteristic as represented by the chain line in the graph of FIG. 10 is not favourable. Accordingly, the inventors' further analysis has shown that, for a practically acceptable blower assembly for use in a vacuum cleaner in terms of the performance and size, the height $B_4$ of each of the exhaust chambers 12 is preferably within the range of $0.14 \cdot D_2$ to $0.28 \cdot D_2$ as hereinbefore described.

Figure 12:
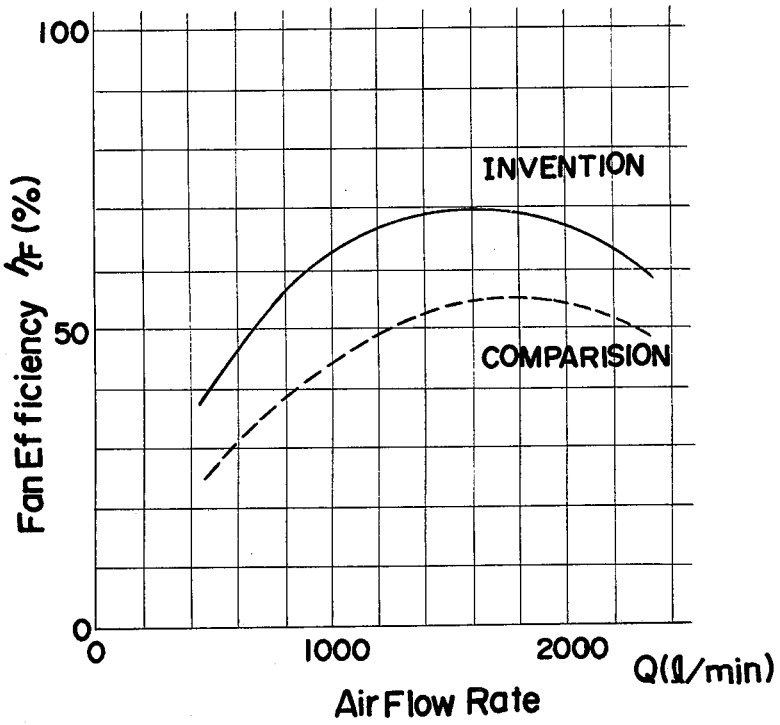
FIG. 12 is a graph showing the relation between the fan efficiency and the amount of air flow, said graph containing two performance curves respectively achieved by the blower assembly of the present invention, as depicted by the solid line, and the conventional blower assembly as depicted by the broken line.

The blower assembly wherein the individual optimum conditions already referred to above and described with reference to the various graphs have been embodied has exhibited a performance characteristic as represented by the solid line in FIG. 12. In the graph of FIG. 12, a similar performance characteristic achieved by the conventional blower assembly used in a vacuum cleaner is illustrated by the broken line. From a comparision of these performance characteristics shown in the graph of FIG. 12, it is clear that the fan efficiency of the blower assembly according to the present invention is superior to that achieved by the conventional blower assembly.

Figure 13:
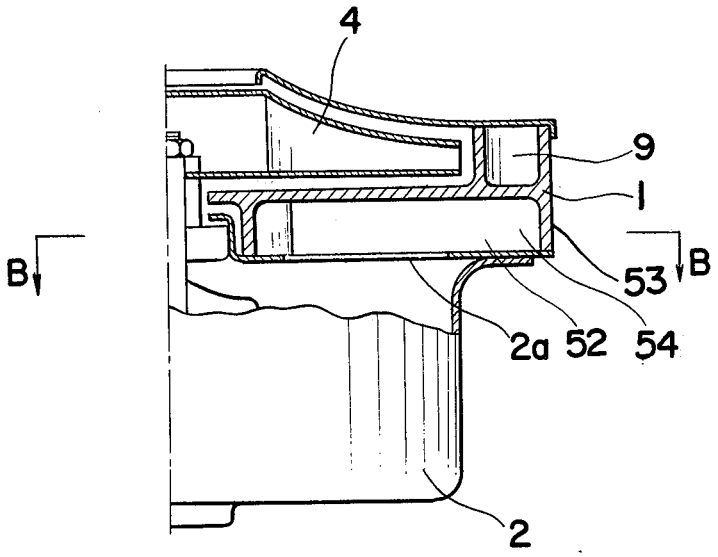
FIG. 13 is a view similar to FIG. 3, showing another preferred embodiment of the present invention.
Figure 14:
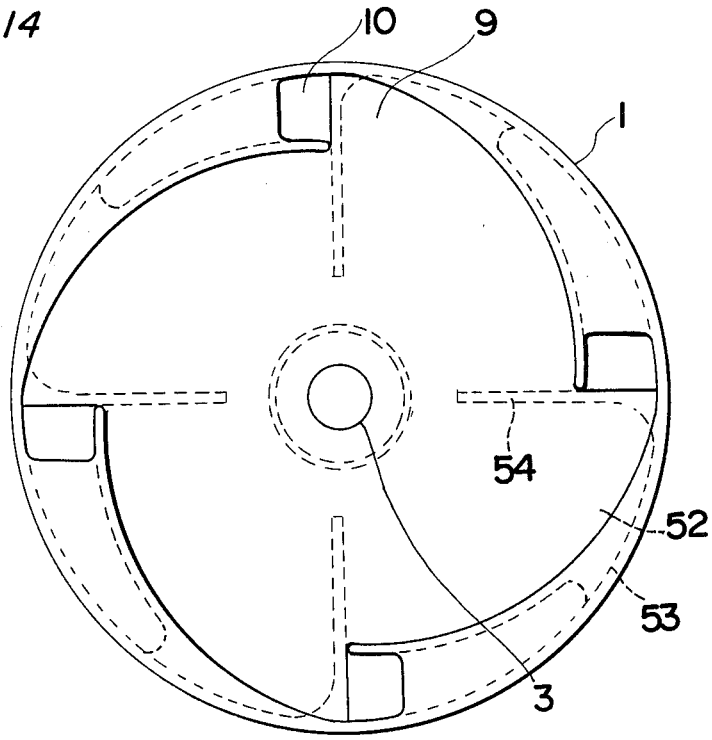
FIG. 14 is a top plan view of an air guide structure with the cover removed, which air guide structure is employed in the blower assembly of FIG. 13.
Figure 15:
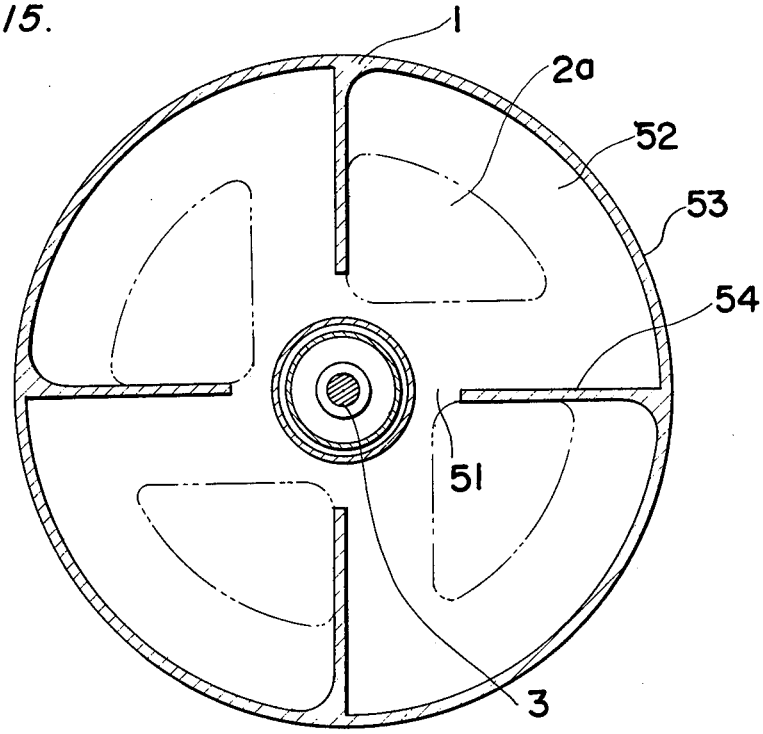
FIG. 15 is a cross sectional view of the air guide structure in a complete form, taken substantially along the line B—B in FIG. 13.

FIGS. 13 to 15 illustrate another preferred embodiment of the present invention, reference to which will now be made in the subsequent description.

In the foregoing embodiment of FIGS. 2 to 6, the exhaust chambers 12 in the rear comparment of the air guide block 1 have been described and shown as formed independently of each other. However, in the embodiment shown in FIGS. 13 to 15, these exhaust chambers, designated by 52 are communicated with each other.

More specically, with reference to FIGS. 13 to 15, partition walls 54 equal in number to the number of the volute chambers 9 radially inwardly extend from a circular wall 53, which defines the rear compartment, and also from respective positions substantially below the inclined passages 10, and terminate adjacent the drive shaft 3 so that a communication space 51 is left between the outer periphery of the drive shaft 3 and each of said partition walls 54. The exhaust chambers 52 are communicated with each other through the individual spaces 51.

In the construction of the blower assembly according to the second preferred embodiment of the present invention shown in FIGS. 13 to 15, the streams of air, which have entered the respective inclined passages 10 in the manner as hereinbefore described in connection with the embodiment of FIGS. 2 to 6, flow into the respective exhaust chambers 54 and then into the motor casing 2 to cool the body of the motor within the motor casing 2, and are finally exhausted to the atmosphere through the exhaust port 2*b* in the motor casing 2. During the flow of air within the exhaust chambers 52, since the partition walls 54 are designed so as to extend in the radially inward direction from the circular wall 53 defining the rear compartment in the air guide block 1, a component of the pneumatic velocity of the air moving in a direction in which such air tends to flow is cancelled and, in other words, the flow of air supplied into the exhaust chambers 52 is advantageously decelerated so that no current of air revolving around the drive shaft 3 will be formed.

On the contrary thereto, if the partition walls 54 are otherwise further inclined in said radially inward direction, any of the streams of exhaust air supplied into the respective exhaust chambers 52 will move into the next adjacent exhaust chamber without being restricted by the corresponding partition wall 54 so that the revolving current will be generated within said next adjacent exhaust chamber. Accordingly, with such design, generation of the revolving current results in considerable loss of energy and the efficiency of air blowing of the blower assembly will be reduced.

However, the blower assembly accoridng to the second preferred embodiment of the present invention substantially eliminates such a disadvantage as hereinabove described.

Furthermore, although turbulent flow may more or less occur in the blower assembly according to the embodiment of FIGS. 13 to 15, the performance is found to be satisfactory as compared with the conventional blower assembly. This is because the individual streams of air, which have been supplied into the respective exhaust chambers 52, can be collected together around the drive shaft 3 and in turn deflected towards the motor casing 2 in a direction substantially parallel to the axis of the drive shaft 3.

Figure 16:
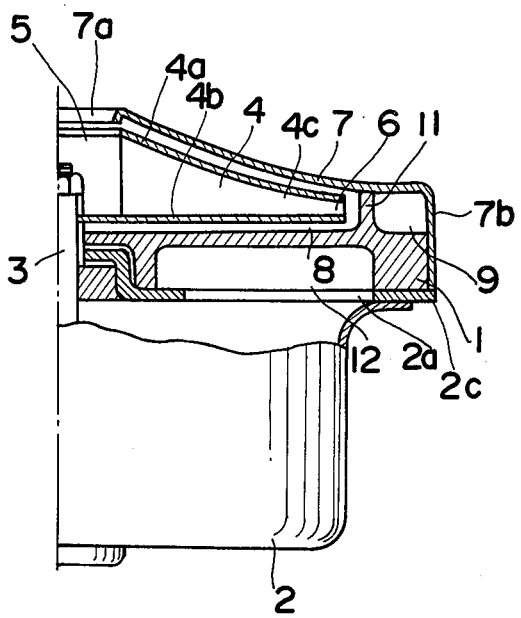
FIG. 16 is a view similar to FIG. 3, showing a further preferred embodiment of the present invention.

FIG. 16 illustrates a further preferred embodiment of the present invention, which is similar FIG. 3 except for a cylindrical portion *7b* of the front cover 7 which extends downwardly from the outer edge of the front cover 7 a certain length so as to cover the outer periphery of the air guide block 1 and to form a portion of the outer wall of the volute chamber 9, thereby to reduce the outer size of the electric blower assembly.

Although the present invention has been fully described in conjunction with the preferred embodiments thereof, it should be noted that various changes and modifications are apparent to those skilled in the art. For example, the present invention can be applicable to a multi-stage impeller assembly wherein a plurality of impellers are arranged one above the other and mounted on the drive shaft 3 for rotation together therewith. In addition, the present invention can also be applicable to a motor casing having suction openings formed in the motor casing at a position different from the illustrated position of the suction openings 2*a*. In other words, the air guide structure according to any of the foregoing embodiments of the present invention can be applicable not only to the illustrated motor casing 2 having the suction openings 2*a* formed therein in the illustrated manner, but also to any of other motor casings having the suction opening formed therein at a different position.

Accordingly, such changes and modifications are to be understood as included within the true scope of the present invention unless they depart therefrom.

What is claimed is:

1. An electric blower assembly which comprises:

an electric motor having a drive shaft rotatable in one direction when said motor is energized;

at least one impeller mounted on said drive shaft for rotation together with said drive shaft;

an air guide structure comprising an air guide block having front and rear compartments formed therein, and a front cover adapted to close said front compartment with said impeller operatively accommodated in said front compartment, said front cover having a central bore formed therein in alignment with said drive shaft, said air guide structure being secured to said motor with said drive shaft rotatably extending into said front compartment through said rear compartment;

said front compartment including a circular chamber, in which said impeller is positioned, and a plurality of volute chambers substantially spirally, radially outwardly extending from and in communication with the periphery of said circular chamber;

said rear compartment opening towards said electric motor and having therein a plurality of exhaust chambers separate from each other and equal in number to the number of said volute chambers;

said motor having air inlet openings equal in number to the number of said exhaust chambers and communicating with said exhaust chambers for passage of air from said exhaust chambers into the body of said motor;

said air guide block further having passages equal in number to the number of said volute chambers, each of said volute chambers having one end terminating adjacent to and in communication with the corresponding one of said passages, said passages respectively communicating said volute chambers to the respective exhaust chambers in said rear compartment and inclined so that streams of air, which have entered the respective volute chambers after having been sucked into said front compartment through said central bore in said front cover and subsequently expelled from the outer periphery of said impeller, can smoothly flow into said exhaust chambers and, thereafter, into the body of said motor to cool the latter.

2. A blower assembly as claimed in claim 1, wherein the distance between the axis of the drive shaft and the terminating end of each of said volute chambers is with in the range of $1.2 \cdot D_2$ to $1.4 \cdot D_2$, wherein $D_2$ represents the radius of the impeller.

3. A blower assembly as claimed in claim 1, wherein the radius of curvature of each wall defining said volute chambers is within the range of $1.0 \cdot D_2$ to $1.3 \cdot D_2$, wherein $D_2$ represents the radius of the impeller.

4. A blower assembly as claimed in claim 1, wherein the depth of each of said volute chambers is within the range of $2 \cdot B_2$ to $3 \cdot B_2$, wherein $B_2$ represents the height of the impeller.

5. A blower assembly as claimed in claim 1, wherein the height of said rear compartment is within the range of $0.14 \cdot D_2$ to $0.28 \cdot D_2$, wherein $D_2$ represents the radius of the impeller.

* * * * *